US006769375B1

(12) United States Patent
Caporella

(10) Patent No.: US 6,769,375 B1
(45) Date of Patent: Aug. 3, 2004

(54) CLAMP-ON CLEATS FOR BOATS

(76) Inventor: Robert Dean Caporella, P.O. Box 4752, Woodbridge, VA (US) 22191

( * ) Notice: Subject to any disclaimer, the term of this patent is extended or adjusted under 35 U.S.C. 154(b) by 3 days.

(21) Appl. No.: 10/270,616

(22) Filed: Oct. 16, 2002

(51) Int. Cl.[7] ..... B63B 21/04
(52) U.S. Cl. ..... 114/218; 114/343; 248/74.5
(58) Field of Search ..... 114/218, 343; 24/135 R–135 N, 376; D8/356, 367, 377; D12/317; 248/74.5, 507, 499; 410/101, 104, 106

(56) References Cited

U.S. PATENT DOCUMENTS

| | | | | | |
|---|---|---|---|---|---|
| 204,770 | A | * | 6/1878 | Smith | 138/99 |
| 238,265 | A | * | 3/1881 | Williams | 160/82 |
| 369,143 | A | * | 8/1887 | White | 403/55 |
| 393,062 | A | * | 11/1888 | Fay | 248/493 |
| 522,639 | A | * | 7/1894 | White | 182/193 |
| 557,984 | A | | 4/1896 | Foran | |
| 725,599 | A | * | 4/1903 | Smith et al. | 24/135 K |
| 760,171 | A | * | 5/1904 | Atwell | 24/310 |
| 850,623 | A | * | 4/1907 | Clark | 248/59 |
| 904,747 | A | * | 11/1908 | Anderson | 24/130 |
| 1,219,199 | A | * | 3/1917 | Troop | 24/376 |
| 1,328,985 | A | * | 1/1920 | Cook et al. | 114/218 |
| 1,565,041 | A | * | 12/1925 | Arney | 24/129 R |
| 1,680,551 | A | * | 8/1928 | King | 24/577.1 |
| 1,749,096 | A | * | 3/1930 | Baxter | 24/376 |
| 2,136,014 | A | * | 11/1938 | McDonald | 114/218 |
| 2,386,836 | A | * | 10/1945 | Blagden | 410/21 |
| 2,469,443 | A | * | 5/1949 | Reiter | 114/218 |
| 2,672,118 | A | * | 3/1954 | Martin | 116/174 |
| 2,833,240 | A | * | 5/1958 | Semolic | 114/218 |
| 2,892,230 | A | * | 6/1959 | Lopez | 294/82.11 |
| 3,125,058 | A | | 3/1964 | Peterson | |
| 3,330,243 | A | * | 7/1967 | Brown | 114/230.25 |
| 3,352,273 | A | | 11/1967 | Herreshoff et al. | |
| 3,431,568 | A | * | 3/1969 | Brown | 441/3 |
| 3,897,745 | A | | 8/1975 | Hutchings | |
| 3,948,203 | A | | 4/1976 | Matthews | |
| 4,200,944 | A | * | 5/1980 | Gillespie et al. | 114/343 |
| D257,421 | S | * | 10/1980 | Cox | D8/382 |
| 4,344,378 | A | * | 8/1982 | Martin | 114/218 |
| 4,352,336 | A | | 10/1982 | Tostado | |
| 4,672,909 | A | * | 6/1987 | Sweetsir | 114/218 |
| 4,708,083 | A | * | 11/1987 | Billings | 114/230.17 |
| 4,998,495 | A | | 3/1991 | Bos et al. | |
| D339,981 | S | * | 10/1993 | Barnes | D8/373 |
| 5,542,367 | A | * | 8/1996 | DuBois et al. | 114/218 |
| 5,634,619 | A | * | 6/1997 | Alessi | 248/219.3 |
| 5,676,508 | A | | 10/1997 | Weicht | |
| 5,690,042 | A | * | 11/1997 | Bentley | 114/39.24 |
| 5,829,377 | A | | 11/1998 | Hoppenhaus | |
| 6,039,520 | A | * | 3/2000 | Cheng | 410/106 |
| 6,216,625 | B1 | * | 4/2001 | Baluha | 114/230.27 |
| 6,256,844 | B1 | * | 7/2001 | Wheatley | 24/265 CD |
| D466,795 | S | * | 12/2002 | Dvorak | D8/367 |

FOREIGN PATENT DOCUMENTS

| | | | | |
|---|---|---|---|---|
| JP | 10160046 A | * | 6/1998 | F16L/3/08 |
| WO | WO 87/03854 | | 7/1987 | |

* cited by examiner

*Primary Examiner*—S. Joseph Morano
*Assistant Examiner*—Ajay Vasudeva
(74) *Attorney, Agent, or Firm*—Swift Law Office; Stephen Christopher Swift

(57) ABSTRACT

A cleat that can be clamped onto a bow rail or spring rail of a boat, using a cylindrical C-clamp. The cleat has two horns that bend inward toward the bow rail at their ends. A middle section joins the clamp and the horns. In the preferred embodiment, the C-clamp has a fixed lower semi-cylindrical member and a pivoting upper semi-cylindrical member. The upper member can be raised to place the clamp around a rail, or to remove it from a rail. Flanges extend from the upper and lower members opposite the side at which the members are pivotally connected and attached to the middle section. Holes pass through the flanges, so that the flanges may be bolted together to secure the clamp on the rail. Rope can be wound around the cleat to keep the rope clean and out of the way when the rope is not being used.

6 Claims, 3 Drawing Sheets

CLAMP-ON CLEATS FOR BOATS

BACKGROUND OF THE INVENTION

1. Field of the Invention

The present invention relates to cleats on the bow or spring rails of boats, around which rope is wound when the rope is not in use.

2. Description of the Prior Art

There are numerous previous inventions of cleats on the bow rails of boats, but none that are equivalent to the present invention.

U.S. Pat. No. 557,984, issued on Apr. 7, 1896, to Michael J. Foran, discloses a cleat with a removable middle portion.

U.S. Pat. No. 3,125,058, issued on Mar. 17, 1964, to Glenn G. Peterson, discloses a boat chock lock and fender and mooring cleat.

U.S. Pat. No. 3,352,273, issued on Nov. 14, 1967, to Alexander G. Herreshoff et al., discloses a cleat made from two separate flanges which are screwed together. U.S. Pat. No. 3,897,745, issued on Aug. 5, 1975, to Ralph Hutchings, discloses a fender cleat having "arms" (i.e., horns) that point inward at the ends. The instant invention is distinguishable, in that in it the cleat has a clamp by which it can be attached to a rail.

U.S. Pat. No. 3,948,203, issued on Apr. 6, 1976, to Joseph E. Matthews, discloses a multiple point securing cleat, with "wing sections" (i.e., horns) that point inward at their ends, but unlike the instant invention, it does not have a clamp.

U.S. Pat. No. 4,352,336, issued on Oct. 5, 1982, to Ramon Tostado, discloses an adjustable cleat, with horns that pivot on a base.

U.S. Pat. No. 4,998,495, issued on Mar. 12, 1991, to William J. Bos and John H. Bos, discloses a fender hanger, for securing fenders and other objects to the safety rail of a boat. It has a hook-shaped curved portion that can be used to attach it to the railing of a boat. It does not have a cylindrical C-clamp nor horns pointing in opposite directions, as does the instant invention.

U.S. Pat. No. 5,676,508, issued on Oct. 14, 1997, to Gary Lee Weicht, discloses a multi-function tie-down device for use with boats, trucks or other vehicles It has downward pointing legs, but does not have a clamp, as does the instant invention. U.S. Pat. No. 5,829,377, issued on Nov. 3, 1998, to Axel Hoppenhaus, discloses a cleat having a base plate to which two arms are pivotally mounted.

International Patent Application No. WO 87/03854, inventor Hannes Marker, published on Jul. 2, 1987, discloses a belaying cleat designed to removably secure a tensioning cable.

None of the above inventions and patents, taken either singly or:in combination, is seen to describe the instant invention as claimed.

SUMMARY OF THE INVENTION

The present invention is a cleat that can be clamped onto a bow rail or spring rail of a boat, using a cylindrical C-clamp. The cleat has two horns that bend inward toward the bow rail at their ends. A middle section joins the clamp and the horns. Rope can be wound around the cleat to keep the rope clean and out of the way when the rope is not being used. Because the horns are bent inward at the ends, the invention may be called a "Bull Horn Cleat".

Accordingly, it is a principal object of the invention to provide a means for keeping rope clean when it is not being used on a boat.

It is another object of the invention to provide a means for keeping rope out of the way when it is not being used on a boat.

It is a further object of the invention to provide a cleat that can be removably attached to the rail of a boat.

Still another object of the invention is to provide a cleat that can be removably attached to any cylindrical rail.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a cleat that can be removably attached to any cylindrical rail. It is designed to be attached to rails on boats (such as the bow rail or the spring rail) but it may also be used on rails that are not on boats. Its intended use is to store rope that is wound around the cleat when the rope is not in use, to keep the rope clean and out of the way.

Figure 1:
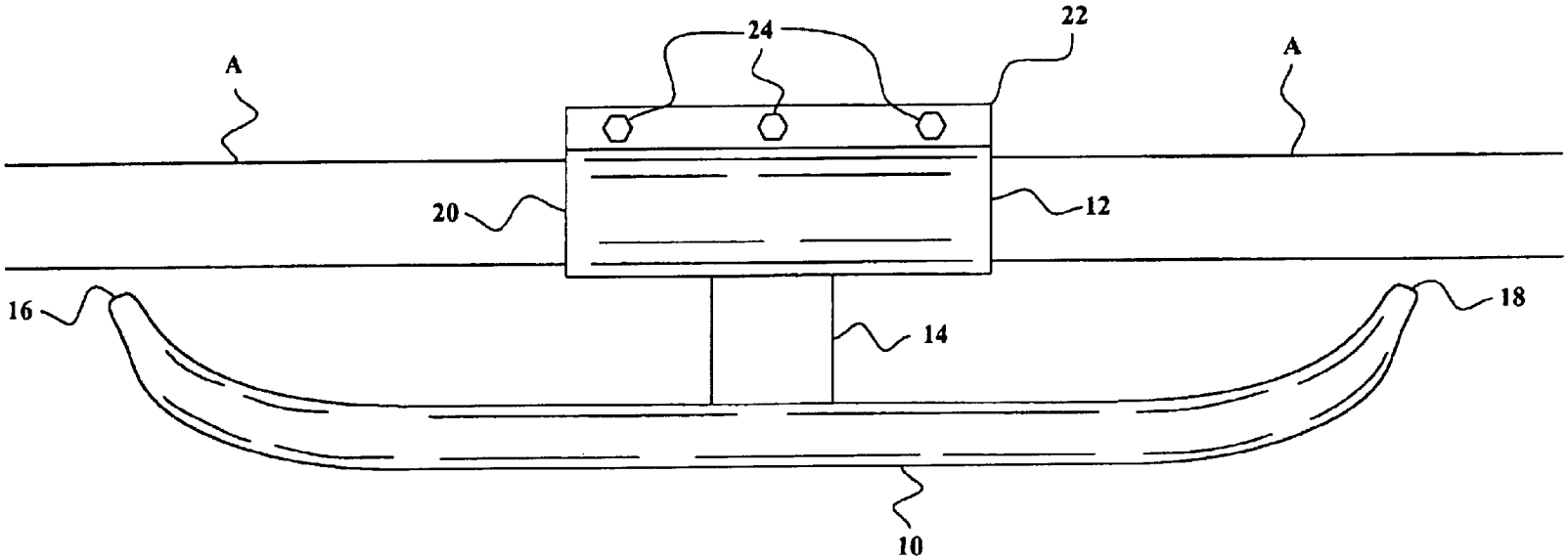
FIG. 1 is top plan view of the preferred embodiment of the invention.

FIG. 1 is top plan view of the preferred embodiment of the invention, showing the generally cylindrical elongated member or cleat 10 (around which the rope is wound), and the clamp 12 attached to the rail A. The elongated member and the clamp are connected by the joining member 14. The elongated member has rounded symmetrical ends 16 and 18 that are turned inwards toward the clamp and rail to prevent rope from sliding off the ends, thus giving the preferred embodiment a "bull horn" shape. The elongated member is preferably rounded, so that cross sections perpendicular to a curved line passing through the longitudinal center of the member will be circular or slightly elliptical. Only the upper member 20 of the clamp is visible in FIG. 1. Flange 22 extends from the upper member. Bolts 24 passing through holes in the flange secure the clamp in a closed position on the rail.

Figure 2:
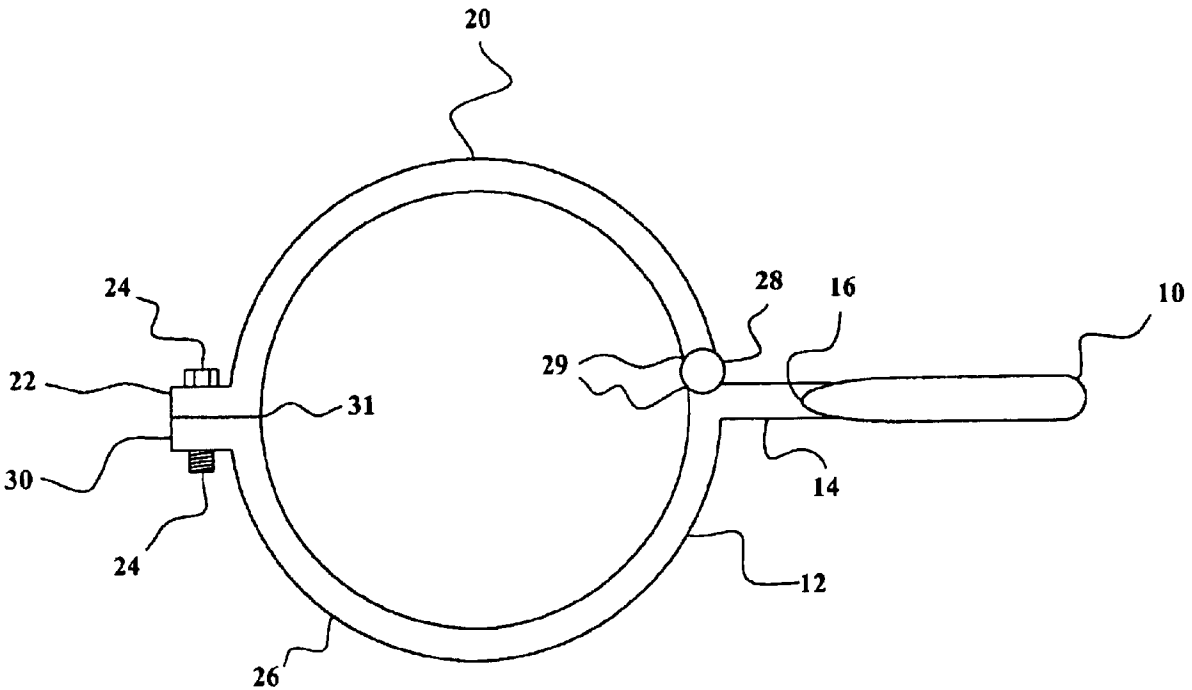
FIG. 2 is left side elevational view of the preferred embodiment of the invention, with the clamp in a closed position.

FIG. 2 is left side elevational view of the preferred embodiment of the invention, with the clamp 12 in a closed position.. The semi-cylindrical upper member 20 is retained on the semi-cylindrical lower member 26 by pivot 28 that connects inner straight edges 29 of the members. Flanges 22 and 30 extend from outer straight edges 31 of the upper and lower members on a side opposite the pivot. The flanges may be fastened together by one or more bolts 24 to keep the clamp closed. The bolts pass through holes (not shown in the drawings) in each flange. The holes may have threaded interiors to more securely retain the bolts. Nuts (not shown in the drawings) may also be used to more securely retain the bolts. Optionally, bolts or screws may be used that have heads and lower shaft ends that are flush with the exterior surfaces of the flanges.

Figure 3:
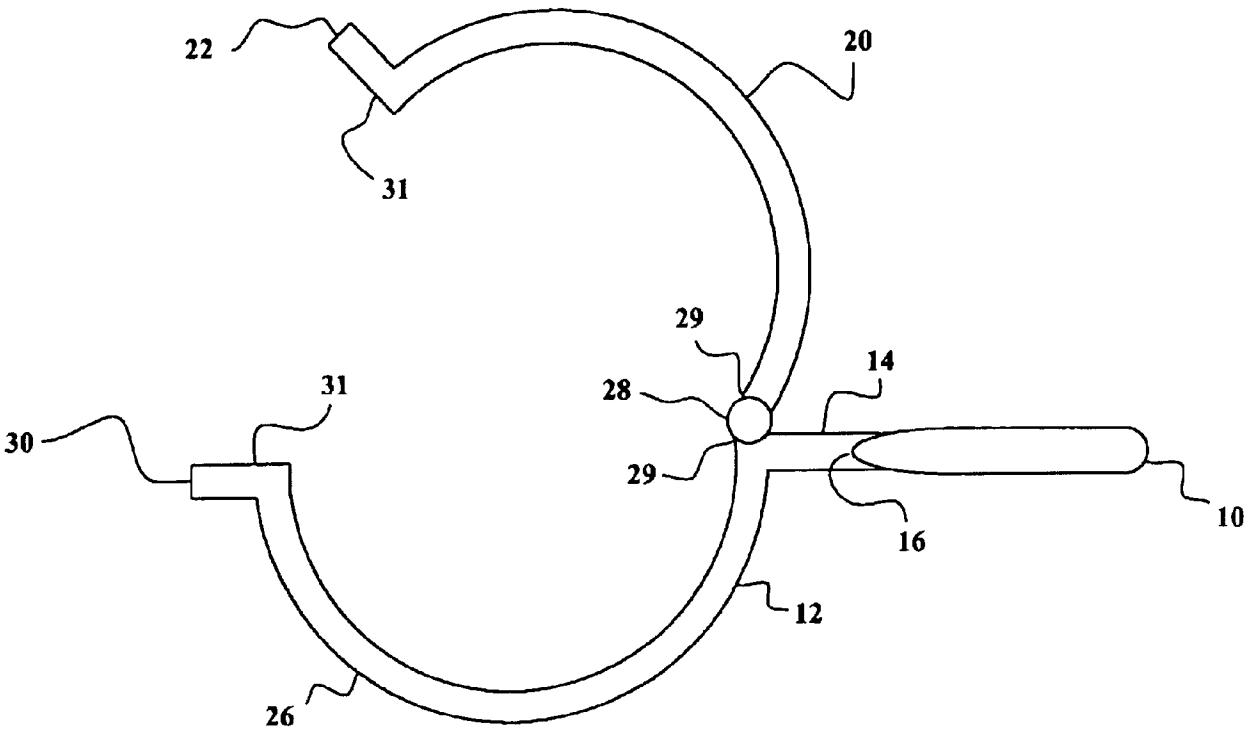
FIG. 3 is left side elevational view of the preferred embodiment of the invention, with the clamp in an open position.

FIG. 3 is left side elevational view of the preferred embodiment of the invention, with the clamp in an open position. The clamp must be in an open position for it to be either attached or removed from a rail.

The invention also includes the use of the cleat in a method for storing rope. It is to be understood that the present invention is not limited to the sole embodiment described above, any and all embodiments within the scope of the following claims.

I claim:

1. A cleat, comprising:

a clamp having a first curved member and a second curved member that is pivotally attached to the first curved member, said first and second curved members being semi-cylindrical, and each having a first straight edge at which they are pivotally connected, and a second straight edge opposite the first straight edge, and said clamp can be moved between an open position in which the second straight edges are apart and a closed position in which the second straight edges are in contact, and a flange extends from the second straight edge of the first and second curved members, and when the clamp is in a closed position the flange of the first curved member is flush against the flange of the second curved member, and at least one hole with a threaded interior passes through each of the flanges, whereby they can be bolted together to retain the clamp in a closed position;

an elongated member with a middle and two rounded ends on opposite sides of the middle that are pointed inwards towards the clamp, said elongated member having a generally circular cross section; and a joining member having a first end to which the clamp is attached and a second end to which the elongated member is attached.

2. The cleat according to claim 1, including a bolt for each hole in the flanges.

3. The cleat according to claim 2, including a nut for each bolt.

4. A method for storing rope, comprising the steps of:

clamping a cleat to a rail; and wrapping the rope around an elongated member of the cleat;

wherein the cleat comprises:

a clamp;

the elongated member, said elongated member having a generally circular cross section, and a middle and two rounded ends on opposite sides of the middle that are pointed inwards towards the clamp; and a joining member having a first end to which the clamp is attached and a second end to which the elongated member is attached;

wherein the rail is generally cylindrical, and the clamp has a first curved member and a second curved member that is pivotally attached to the first curved member;

wherein the first and second curved members of the clamp are semi-cylindrical, and the first and second curved members of the clamp each have a first straight edge at which they are pivotally connected, and a second straight edge opposite the first straight edge, and the clamp can be moved between an open position in which the second straight edges are apart so that it can be placed over or removed from the rail, and a closed position in which the second straight edges are in contact so that it can be fastened to the rail.

5. A method for storing rope according to claim 4, wherein a flange extends from the second straight edge of the first and second curved members, and when the clamp is in a closed position the flange of the first curved member is flush against the flange of the second curved member.

6. A method for storing rope according to claim 5, wherein at least one hole with a threaded interior passes through each of the flanges, whereby they can be bolted together to retain the clamp in a closed position.

* * * * *